US007124448B2

(12) United States Patent
Davenport

(10) Patent No.: US 7,124,448 B2
(45) Date of Patent: Oct. 24, 2006

(54) PANTS CONSTRUCTION STABILIZED BY INTEGRAL UNDERGARMENT

(76) Inventor: Irese Davenport, 2015 W. Pine St., Apt. 5, Orlando, FL (US) 32805

( * ) Notice: Subject to any disclaimer, the term of this patent is extended or adjusted under 35 U.S.C. 154(b) by 0 days.

(21) Appl. No.: 10/842,616

(22) Filed: May 10, 2004

(65) Prior Publication Data

US 2005/0246820 A1 Nov. 10, 2005

(51) Int. Cl.
*A41D 1/06* (2006.01)
*A41D 27/08* (2006.01)

(52) U.S. Cl. ..... 2/229; 2/227

(58) Field of Classification Search ..... 2/400–409, 2/311, 476, 69, 73, 76, 247, 78.1–79, 220, 2/221, 228–230, 236–238, 336–340, 269, 2/111, 75, 80

See application file for complete search history.

(56) References Cited

U.S. PATENT DOCUMENTS

| | | | | | |
|---|---|---|---|---|---|
| 1,764,483 | A | | 6/1930 | Watkins | |
| 2,034,312 | A | | 3/1936 | Rubin | 2/228 |
| 2,599,769 | A | * | 6/1952 | Macrae et al. | 2/228 |
| 3,064,265 | A | * | 11/1962 | Bridgewaters | 2/74 |
| 3,435,462 | A | * | 4/1969 | Bank | 2/227 |
| 3,840,901 | A | | 10/1974 | Eyster | 2/247 |
| 4,069,513 | A | * | 1/1978 | Shiller et al. | 2/227 |
| 4,215,435 | A | | 8/1980 | Miele | 2/227 |
| 4,513,454 | A | | 4/1985 | Anderson et al. | 2/246 |
| 4,825,475 | A | | 5/1989 | Smart | 2/312 |
| 5,054,127 | A | | 10/1991 | Zevchak | 2/247 |
| 5,168,582 | A | * | 12/1992 | Aldridge | 2/305 |
| 5,675,842 | A | | 10/1997 | Schaefer | 2/237 |
| 5,689,832 | A | * | 11/1997 | Head | 2/227 |
| 5,774,892 | A | | 7/1998 | Tisdale et al. | 2/69 |
| 6,058,508 | A | * | 5/2000 | Brown Honeysuckle | 2/69 |
| 6,108,823 | A | * | 8/2000 | Danes | 2/403 |
| 6,202,220 | B1 | | 3/2001 | Rhoden | 2/236 |
| 6,223,352 | B1 | * | 5/2001 | Watlington | 2/80 |
| 6,266,822 | B1 | * | 7/2001 | Joyce | 2/83 |
| 6,308,338 | B1 | | 10/2001 | Caldwell | 2/312 |
| 6,360,372 | B1 | * | 3/2002 | Oster | 2/126 |
| 6,397,398 | B1 | | 6/2002 | Herder | 2/249 |
| 6,665,882 | B1 | * | 12/2003 | Pedrick | 2/228 |
| 6,789,270 | B1 | * | 9/2004 | Pedrick | 2/228 |
| 6,817,030 | B1 | * | 11/2004 | Desai | 2/67 |
| 6,922,849 | B1 | * | 8/2005 | Fedrick | 2/227 |
| 2004/0049834 | A1 | * | 3/2004 | Stangle et al. | 2/338 |
| 2004/0163159 | A1 | * | 8/2004 | Edwards et al. | 2/338 |

* cited by examiner

*Primary Examiner*—Alissa L. Hoey
(74) *Attorney, Agent, or Firm*—Ernest D. Buff & Associates, LLC; Ernest D. Buff; Theodore J. Pierson

(57) ABSTRACT

A pants construction comprises an undergarment having a drawstring, elastic band or other securing mechanism on the waistband. The undergarment is attached to the inside of a pair of pants or shorts with a hook and loop type fastener, buttons, zippers, snaps, tie strings, temporary glue or the like. The attachment is concealed; and is arranged such that at least some of the upper portion of the undergarment is revealed above substantially the entire circumference of the waistband of the pants, and the waistband of the pants is below the waist of the wearer. This conveys a perception that the pants are far below the waist. A securing mechanism associated with the undergarment stabilizes the pants to prevent them from falling down.

59 Claims, 5 Drawing Sheets

PANTS CONSTRUCTION STABILIZED BY INTEGRAL UNDERGARMENT

BACKGROUND OF THE INVENTION

1. Field of the Invention

The present invention relates to the field of clothing; and more particularly, to a pants construction stabilized by an integral undergarment wherein the pants are perceived to be worn below the waist.

2. Description of the Prior Art

Styles change over the years. A recent trend for persons of all ages is to wear their pants down below their waist such that their undergarment is revealed. When worn in such a fashion, the pants are sometimes secured by tightening a belt around the lower hips of the wearer. Often, however, such an attempt is fruitless, and the wearer often finds himself constantly using one or both of his hands to hold his pants in place so they do not fall down. The problem is particularly troublesome when the wearer is participating in athletics or exercising, each of which activities exerts additional forces on the pants. Use of one's hands to keep one's pants from falling down is burdensome and frustrating. Such use of the hands, and the distraction caused thereby, may hinder the performance of the wearer during many activities, including basketball, football, skateboarding, and other athletic sports.

Pants having two waistbands and pants having a waistband that is below the waist of the wearer are known in the art. However, the prior art lacks the salient features and advantages of the present invention as described herein. The following is a summary of the relevant prior art.

U.S. Pat. No. 2,034,312 to Rubin discloses a garment for boys. The garment comprises, among other components, a construction whereby trousers and the corresponding articles of underwear, may be supported from the waist and from the hips. More particularly, there is disclosed an arrangement whereby two such garments may be maintained and associated for ready assembly and disassembly, and may be supported from the hips and the waist and readily removed therefrom as a unit while in such associated relation. The respective waistbands of the boys' trousers and drawers line up such that they remain at the same level along the waistband of the wearer. The undergarment is not visible when the two garments are in their associated relation.

U.S. Pat. No. 5,675,842 discloses pants having two waistbands. The pair of pants comprises pants defining a first waistband, the first waistband being made substantially of a first material. A second waistband is made substantially of a second material having elastic properties. Connecting means made substantially of a third material secure the second waistband to the pants. The wearer has the option of having the second waistband hidden behind the pants or visible above the first waistband. The pants taught by the '842 patent do not include an undergarment. The "sag" style, which specifically includes the visibility of the upper portion of the undergarment, in addition to the waistband of the undergarment, is not disclosed by the '842 patent.

U.S. Pat. No. 5,689,832 discloses sagging double bottom pants. The sagging double bottom is an added separate layer of matching fabric material overlying the rear surface areas of the trousers or pants. The added layer of fabric material covers the seat portion of the trousers or pants, as well as preferably the rear surface portions of the upper end portion of each leg. The added fabric layer is attached to the trousers or pants along the side seams and along the inseams up to and including the center seam in the crotch area. The '832 patent teaches that the sagging bottom only covers the rear seat portion of the pants and ends at the side seams where it is attached to the pants. The top waistline of the sagging bottom is unattached to the pants such that the added fabric layer extends downwardly in an arcuate configuration by the force of gravity.

U.S. Pat. No. 6,202,220 to Rhoden discloses drop crotch pants such that when such pants are worn with a garment such as a shirt or blouse, the lower edge of the shirt or blouse serves to obscure the portion of pants above the false waistband, thereby creating the illusion that a traditional pair of single-waistband pants are being worn at a level below the waist. Similar to the '832 patent discussed hereinabove, the '220 patent discloses drop crotch pants wherein the material above the false waistband matches the material below the false waistband. This configuration is not in style, especially when wearing pants without a shirt or a shirt that falls above the false waistband or is tucked-in because the preferred style is to have the undergarment of the wearer visible above the sagging pants waistband.

U.S. Pat. No. 6,308,338 to Caldwell discloses trouser suspenders wherein the extenders are attached directly to the undergarment preferably at the undergarment waistband, such that the waistband forms the waist strap for the trouser suspenders. Fasteners are attached to the lower end of the extenders which attach to the trousers. The '338 patent comprises trouser suspenders which comprise two extenders which are visible and reside along the outside of the visible portion of the undergarment.

Because the '338 patent relies on only two extenders to support the entire load of the pants, their support is ineffective. High load concentrations extant at the points where the extenders attach to the waistband of the undergarment tend to produce localized sagging of the waistband of the undergarments at these locations. The result can be dangerous. Physical activity can lead to the unexpected falling down of the undergarment/pants union, exposing the private parts of the user.

There remains a need in the clothing art for a pants construction which solves the problems associated with wearing one's pants below the waist so that the undergarment is revealed. Especially advantageous would be a pants construction which addresses these problems, such as the tendency for the pants to fall down, while at the same time providing a stylish ensemble suitable for people of all ages and either sex.

SUMMARY OF THE INVENTION

The present invention provides a pants construction comprising; a pair of pants, having an inside portion, an outside portion and a waistband. The pants are of adequate size so as to be capable of being worn by a wearer. They comprise a waist, and buttocks having a top edge and a bottom edge; an undergarment. The undergarment has an upper portion, a lower portion and a waistband. It is removably attached to said inside portion of the pair of pants by an attachment means that remains hidden thereinside. At least some of the upper portion of the undergarment is revealed above the entire circumference of the pants waistband. The waistband of said pants is below the waist of said wearer and the waistband of the undergarment is worn substantially near the waist of said wearer. A securing mechanism attached to said waistband of said undergarment provides stabilization to prevent the pants from falling down.

The present invention solves the problems associated with wearing one's pants below the waist, such as the tendency for the pants to fall down. At the same time, there is provided in accordance with the invention a stylish ensemble suitable for people of all ages and both sexes. The present invention achieves this goal by presenting a stylish pants construction having the appearance that the pants are below the waist of the user. A securing mechanism hidden inside the pants prevents the pants from falling down; yet presents the appearance that the undergarment is unattached to the pants.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

The pants construction of the current invention comprises a pair of pants having an inside portion, an outside portion and a waistband. The pants are of adequate size to be capable of being worn by a wearer, and comprise a waist and buttocks. The buttocks has a top edge and a bottom edge. An undergarment associated with the pants has an upper portion, a lower portion and a waistband. The undergarment is removably attached to the inside portion of the pants pair by an attachment means that remains hidden inside the pants. With this arrangement, at least some of said upper portion of the undergarment is revealed above the circumference of the pants waistband, which rides on the hips, below the waist of said wearer. The waistband of the undergarment is worn substantially near said waist of the wearer while a securing mechanism attached to said waistband of the undergarment provides stabilization to prevent said pants from falling down.

An alternative embodiment of the present invention comprises a pair of pants having an undergarment which is sewn to the pants, thereby permanently attaching the undergarment to the pants.

Figure 1:
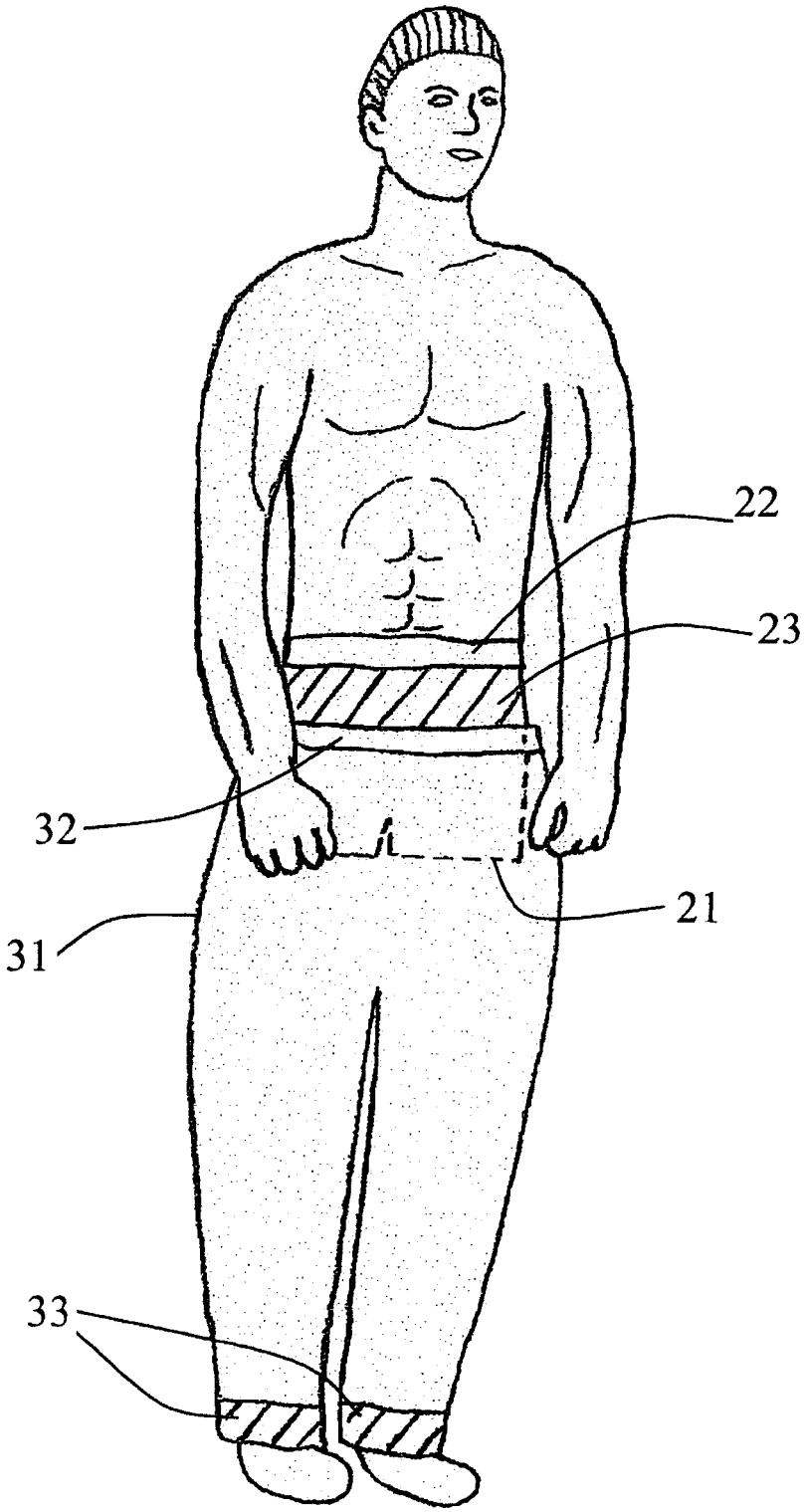
FIG. 1 is a front view depicting the pants construction, wherein the wearer is not wearing a shirt.
Figure 2:
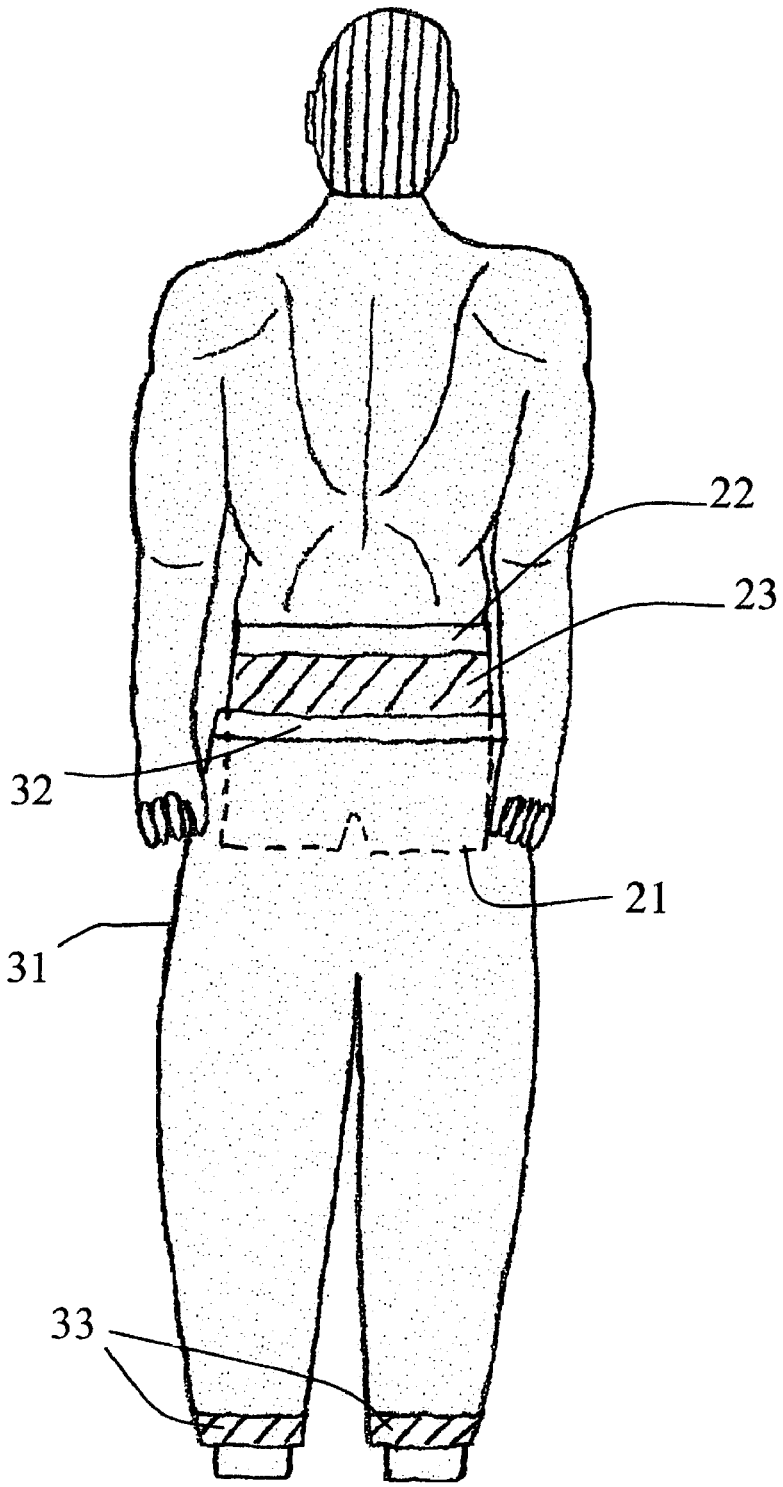
FIG. 2 is a rear view of the pants construction shown by FIG. 1.

The pants construction of the present invention is depicted by FIGS. 1 and 2. FIG. 1 is a front view of the pants construction. FIG. 2 is a rear view of the pants construction. In both figures, the person wearing the pants construction is not wearing a shirt to enable an unobstructed view of the configuration of the present invention.

Persons wearing the pants construction may choose not to wear a shirt during certain activities, such as when playing sports or exercising, during the summertime, or simply by choice. If a wearer is not wearing a shirt or is wearing a low-cut shirt, the pants construction of the present invention will still be very stylish and will appear as though the undergarment 21 and pants 31 are not attached, but are simply being worn in a manner such that the waistband of the pants 32 is below the waist of the wearer 22. However, the advantages attendant to the present invention will still exist to the delight of the wearer. It should be understood that the waistband of the pants 32 is perceived to be below the waist of the user 22 along the entire circumference of the pants 31 and from all viewing angles, including the front view.

The undergarment 21 is removably attached to the inside of the pair of pants 31 at any location along the undergarment and along the inside of the pants. Preferably, the undergarment 21 is removably attached to the pants 31 along substantially the entire circumference of both the undergarment 21 and the pants 31. The attachment means cover a percentage of the circumference of the inside portion of the pair of pants and corresponding undergarment, wherein this percentage is in the range of 5% to 100%. The percentage range that is selected is determined based on the type of attachment means, the weight and type of the pants, the type of activities that will be exercised while wearing the pants construction, and other design considerations.

The removable attachment means may comprise a hook and loop type fastener (sometimes referred to as Velcro®, buttons, zippers, snaps, or the like, each of which are readily known to those skilled in the art.

Another embodiment for the removable attachment means includes small apertures located along a horizontal plane around the perimeter of the pants, below the waistline, wherein the apertures are formed completely through the pants. In this embodiment, the undergarment includes tie strings along the lower edge of the undergarment. These tie strings are inserted through the apertures of the pants and are tied in order to secure the undergarment to the pants. The number of apertures formed on the pants, along with the number of corresponding tie strings, is a design choice. A preferred range for the number of pairs of apertures and corresponding tie strings is in the range of 2–20.

Another embodiment for the removable attachment means includes temporary glue that is applied at the appropriate location along a horizontal plane about both the outer perimeter of the undergarment and the inner perimeter of the pants. The term "temporary glue" as used in this specification shall mean glue which may be broken down through a post process, and does not in any way refer to the glue's ability to hold its bond while the user is wearing the pants construction. After applying the glue and connecting the undergarment to the pants, pressure is applied for a few moments while the glue cures. Once the glue has cured, the user may wear the pants construction having the pants secured to the undergarment. After wearing the pants construction, the user will subject the entire pants construction to a post process by laundering the garments in a standard washing machine. The combination of heat, detergent and agitation encountered in the washing machine will detach the pants from the undergarment and will completely wash out all of the temporary glue from both of the garments. The attachment process may be continuously repeated.

The location where the undergarment 21 is removably attached to the inside of the pair of pants 31 is along any horizontal plane at any point along the full height of the undergarment 21 and corresponds to any horizontal plane at any point along the inside of the pair of pants 31 between the crotch and the waistband of the pants.

Figure 3:
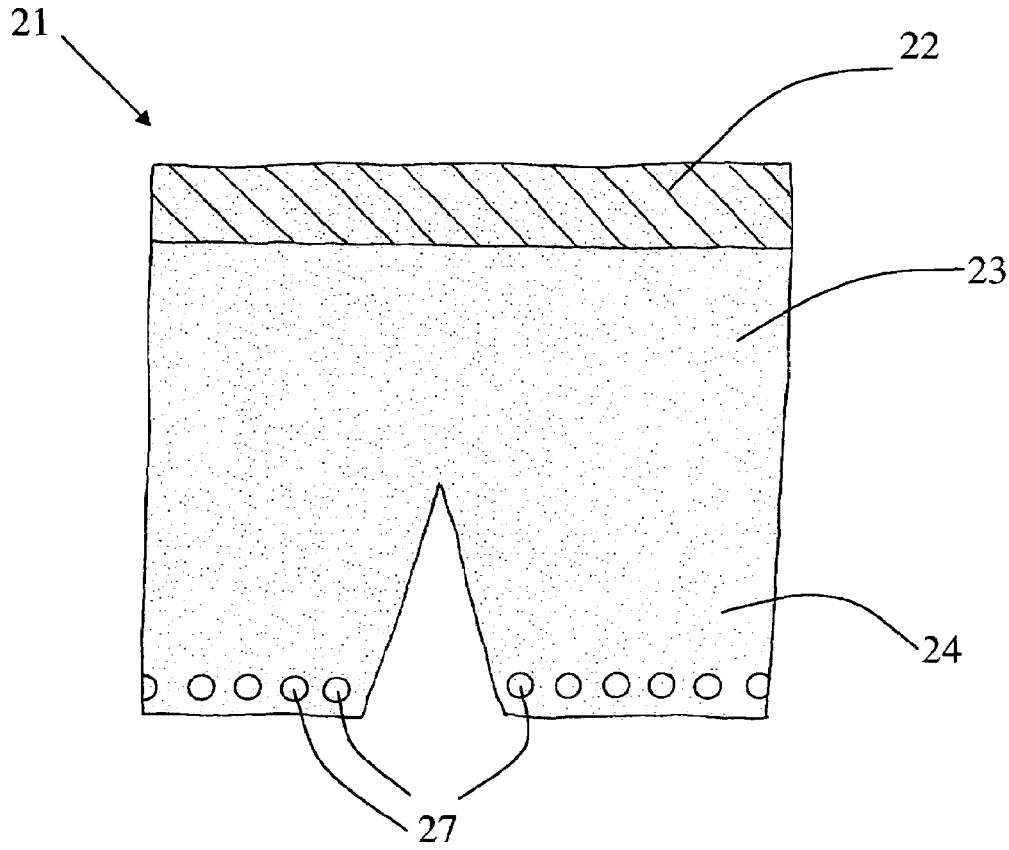
FIG. 3 is a front view depicting one embodiment of the undergarment, having attachment means located along the lower edge of the undergarment.

FIG. 3 is a front view depicting one embodiment of the undergarment 21 having a waistband 22, wherein the attachment means 27 are located along the outer edge of the lower portion 24 of the undergarment, shown here as snaps. In this embodiment, it is preferred to use a pair of pants (not shown in this figure) having one or more horizontal rows (preferably three rows) of attachment means located on the inside of the pants, shown as snaps in FIG. 4, whereby the undergarment attachment means 27 are associated with any one of the rows of pants attachment means, according to the amount of sag that is desired by the wearer. Depending on the amount of sag that is selected by the wearer, more or less of the upper portion 23 of the undergarment will be revealed above the entire circumference of the waistband of the pants. Here, the pants attachment means are located about the perimeter of the pants, and include any of the types described herein.

Figure 4:
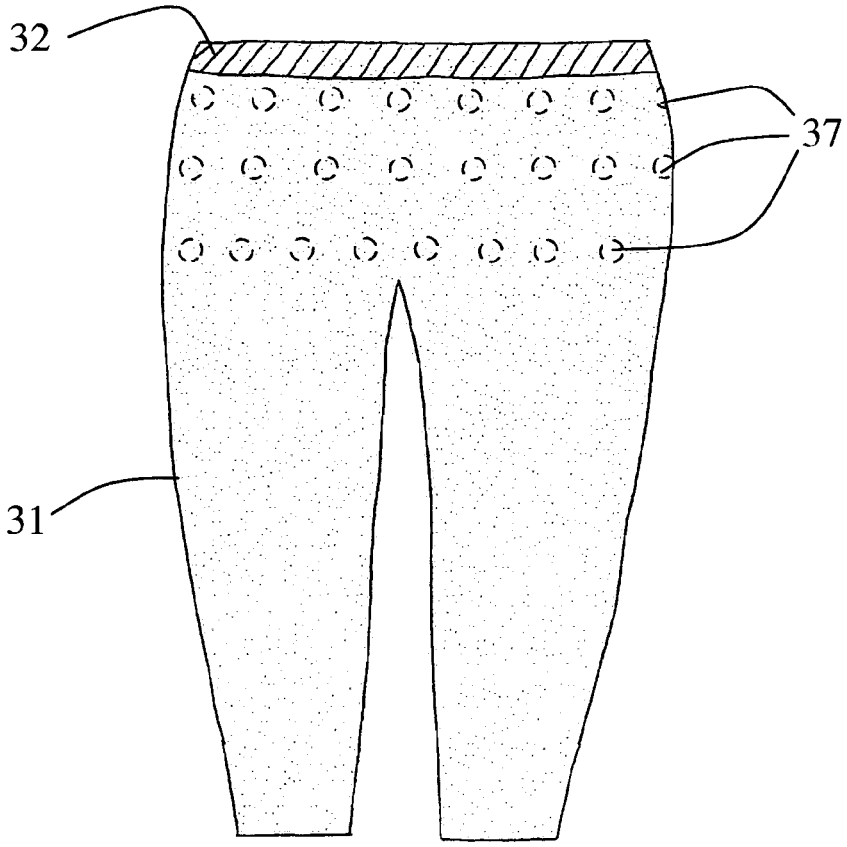
FIG. 4 is a front view depicting one embodiment of the pair of pants, having three rows of attachment means located about the perimeter of the pants.

FIG. 4 is a front view depicting one embodiment of the pants 31 having a waistband 32, wherein there are one or more horizontal rows (preferably three rows) of attachment means 37 located on the inside of the pants, shown here as snaps which are dashed to show that the snaps are located inside the pants. The undergarment 21 is attached to the appropriate row of attachment means 37 to achieve the desired sag length of the pants construction. One snapped into place, the unused snaps would still be invisible to the viewer, thereby conveying the impression that the undergarment and pants are not attached.

Figure 5:
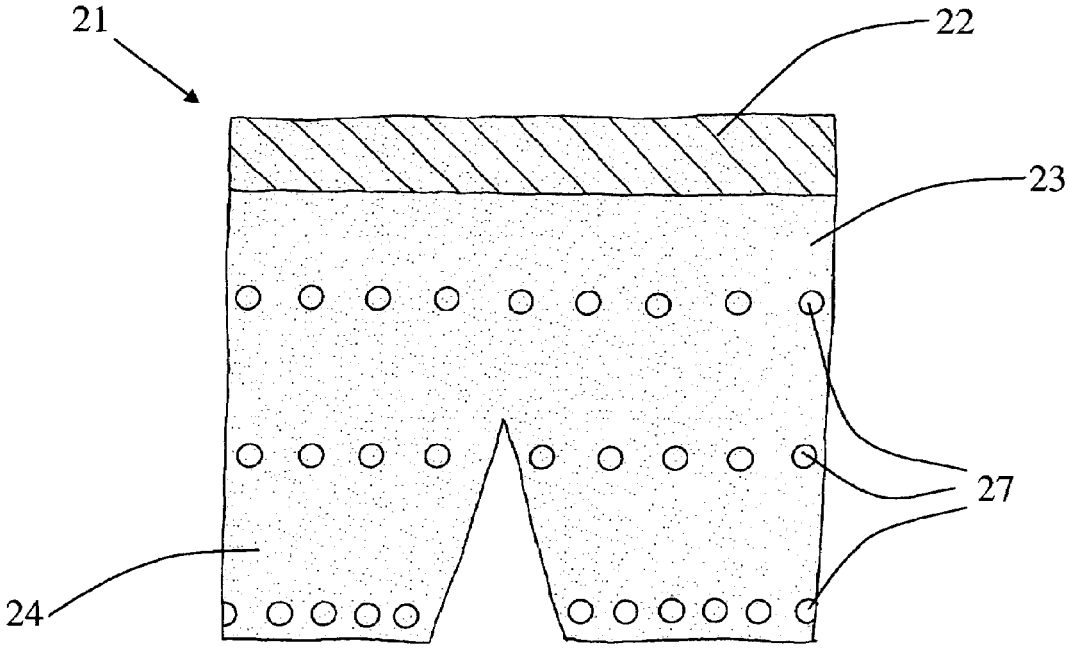
FIG. 5 is a front view depicting one embodiment of the undergarment, having three rows of attachment means located about the perimeter of the undergarment.

FIG. 5 depicts another embodiment of the undergarment 21 having a waistband 22 which has one or more horizontal rows (preferably three rows) of attachment means 27 located on the outside of the undergarment, shown here as snaps. The attachment means 27 are located at any location in either the upper portion 23 or lower portion 24 of the undergarment. In this embodiment, the corresponding attachment means on the inside of the pants (not shown in this figure) is located along or substantially near the waistband of the pants. In this embodiment, the user can select the desired sag length by attaching the undergarment 21 to the pants at the appropriate row of attachment means 27 on the undergarment. Depending on the amount of sag that is selected by the wearer, more or less of the upper portion 23 of the undergarment will be revealed above the entire circumference of the waistband of the pants. In one aspect, a first horizontal row of attachment means is located at the upper portion of the undergarment and a second horizontal row of attachment means is located at the lower portion of the undergarment. In another aspect, a third horizontal row of attachment means is located in-between the upper and lower portions of the undergarment, respectively. As before, the attachment means include any of the types described herein.

In the embodiment wherein the undergarment 21 is permanently sewn to the pants 31, the stitching may either be "hidden" along the waistband of the pants 32, or slightly below the waistband of the pants. Such stitching would be less noticeable if it were located along or substantially close to the waistband of the pants 32 for obvious reasons. Additionally, it is advantageous to have the stitching along the waistband of the pants 32 so that the stitching does not interfere with any side or back pockets on the pants, especially if the pockets were already attached to the pants before such stitching occurred.

It is preferred, but not required, that the undergarment 21 be removably attached to the inside of the pants 31, rather than permanently sewn to the pants, for several reasons. First, this allows the wearer to regularly change the undergarment 21 to allow them to be laundered separately from the pants 31. Undergarments are usually worn once, and then are laundered. However, pants may be worn several times before they need to be laundered. By allowing the undergarment 21 to be interchanged with the pants 31, the wearer may launder the undergarment 21 separately from the pants 31, therefore preserving the pants 31 from the damage they may endure from excessive laundering. Additionally, a wearer may have several different undergarments which they can alternate with the pants to provide for many different styles. Still further, this allows the opportunity to sell the undergarments and pants separately at the retail level so that a wearer may purchase several different undergarments for the same pair of pants.

The undergarment 21 may consist of boxers, briefs, long johns, panties, thongs, g-strings, lingerie or the like. The undergarment 21 is of the type readily known by those skilled in the art. The undergarment 21 is preferably a different overall design from the pants, such as being a different color, a different pattern, a different material, and so forth. This is advantageous because it highlights the fact that the undergarment 21 is separate from the pants 31, and enhances the desired style of wearing one's pants below the waist to reveal the undergarment.

In one embodiment, the shape of the undergarment 21 is slightly adapted to correspond with the circumference of the waistband of the pants 32 with which they are attached. More specifically, the circumference of the attachment location on the undergarment should be substantially equal to the circumference of the attachment location on the pants, i.e. the waistband of the pants 32. If these measurements are not substantially equal, then the result would be that the garment having the larger circumference would have excess material, as described hereinabove, which is not desirable. However, the selection of the type of attachment means may obviate the need to address this problem since, for example, the use of a hook and loop type fastener, buttons, glue, or the like would accommodate for any variation between the circumference of the connection location of the undergarment and the circumference of the connection location of the pants. For example, if the circumference of the connection location of the pants is larger than the circumference location of the undergarment, then a portion of the circumference location of the pants could simply be left free without compromising the strength of the bond of the attachment of the undergarment and pants.

The waistband of the undergarment 22 may further comprise a securing mechanism to provide stabilization to prevent the pants from falling down. The securing mechanism may include a drawstring or an elastic waistband, or a combination of the two; or any other securing mechanism. Such securing mechanisms are of the type readily known by those skilled in the art and require no further explanation. When the securing mechanism is secured about the waist of the wearer 22, the pants construction is stabilized because of the attachment of the pants 31 to the undergarment 21.

The waistband of the undergarment 22 is preferably worn substantially near the waist of the wearer 22. This provides optimal positioning for the securing mechanism to adequately stabilize the pants construction, such as with a drawstring and/or elastic band. It also provides for optimal comfort to the wearer, as it is natural to have the pants construction supported substantially near the waist 22. Wearing the undergarment 21 in this manner also provides for a stylish look, especially in the situation where the wearer is not wearing a shirt or is wearing a low-cut shirt, because the undergarment 21 looks stylish when the waistband of the undergarment 22 is worn substantially near the waist of the wearer 22.

The fly opening of the undergarment 21 optionally has a lightweight zipper, buttons or the like, and the top of the undergarment is secured by a drawstring, elastic waistband or other securing mechanism. Optionally, the material of the undergarment of the present invention is close to twice as thick as conventional undergarments, which will enable maximum durability and useful life. In other embodiments of the pants construction, the thickness of the undergarment can range from less than half as thick to more than twice as thick as a conventional undergarment. The thickness of the undergarment, however, may vary greatly for reasons readily known to one having skill in the art, and requires no further explanation.

The pants construction is stylish, attractive and very much in vogue. At the same time, it is much safer to wear than pants constructions that rely strictly on fastening mechanisms associated with the belt loops of the pants.

The present invention provides a pants construction which follows the "sagging" style of wearing one's pants while showing the undergarment, but achieves this look without revealing the fact that the support of the pants is achieved with the help of the undergarment to which the pants are attached (since the attachment means remain hidden inside the pants). In addition, by having the load of the pants evenly distributed along the circumference of the undergarment, their support is more uniform and therefore more effective in keeping the pants construction in place, especially during physical activity, as compared, for example, to a device that relies on independent suspenders.

Removable back pockets or patches on the pants knees may optionally be provided and are preferably composed of material that matches the undergarment 21. Removable cuffs 33 may be provided and are also preferably composed of material that matches the undergarment 21. Such removable pockets, patches, and cuffs are readily known to those having skill in the art and require no further explanation. The waistband of the pants 32 may optionally include belt loops of the type generally known to one skilled in the art.

Different types of undergarments may be utilized with the present invention, such as briefs, boxers, long johns, panties, thongs and the like. In addition, different types of pants may be utilized with the present invention, such as jeans, sweatpants, warm-up pants, slacks, shorts, athletic shorts, swim suits, skirts, mini-skirts and the like. In the case where the mini-skirt (or other skirt) is used for the pants structure, a matching scarf may optionally be worn by the user. These different undergarments and pants are readily known to one having skill in the art, and require no further explanation. Such undergarments and pants may be made from many different types of materials, all of which are known in the art.

The present invention solves the problems associated with wearing one's pants below the waist. In particular, wearers will not need to constantly keep pulling their pants up in order to keep them from sliding down and out of place; wearers will not need to hold their pants up with one or both hands in order to walk faster without their pants sliding down; wearers will not incur the risk of having the pants fall completely down in times of trouble, such as being confronted with a situation where one must elect to physically fight or take flight. In such situations, if one's pants will not stay up, the election to do either is strictly curtailed. Moreover, wearers will not be restricted during attempts to do simple things that most take for granted, such as playing sports, walking, running, and having a simple conversation without "baby-sitting" their pants.

The subject invention solves all of these problems simply by making the undergarment 21 a semi-permanent, or permanent, fixture of the pants 31 or shorts through the use of a hook and loop fastener, buttons, zippers, snaps, tie strings, temporary glue or the like. The usage of the term "semi-permanent" highlights the fact that the undergarment can be removed from the pants. The term "permanent", as used herein, highlights the fact that the undergarment can be sewn to the pants or shorts. The resulting pants construction is very comfortable and is virtually maintenance free. Wearers can simply put on the pants construction as a single unit, in a very easy manner, adjust the securing mechanism to an appropriate tension, and then be on their way.

The pants construction of the current invention operates by giving the illusion that a regular undergarment 21 is being worn under the pants 31 without tampering with the "bad boy" image that most of the persons who wear their pants low are striving to achieve. Additionally, the pants 31 may include an outer drawstring, button-fly, zipper-fly, or the like. These mechanisms are purposefully left loose to give the perception that the pants are about to fall down.

The pants construction of the present invention has three basic sag lengths. The sag lengths are defined by where the waistband of the pants 32 is located with respect to the buttocks: at the top edge of the buttocks, at the bottom edge of the buttocks, at a midpoint between the top edge and the bottom edge of the buttocks. It is noted that any sag length between the top edge of the buttocks and the bottom edge of the buttocks is achievable by this invention. Additionally, the waistband of the pants may be located below the bottom edge of the buttocks, for "extreme saggers". When determining the sag length, it must be understood that the pants construction is worn so that the waistband of the undergarment 22 is substantially near the waist of the wearer 22. FIGS. 1 and 2 show the waistband of the undergarment 22 to be located at the waist of the wearer 22.

The consumers will determine the relative "bagginess" of the pants construction by simply buying an appropriate size. Significantly, flexibility attends the consumer's purchase and wearing decisions, because the securing mechansim of the pants construction enables the larger sizes to stay in position as well. The pants construction may be manufactured in a wide variety of sizes and styles to accommodate infants, adults, male or female, and may be manufactured to accommodate persons having a height ranging from 10 inches to 100 inches. It should be understood that infants are persons under the age of 18; adults are persons 18 years old or greater.

The style of the pants construction may be incorporated into the overall design of the pants, jeans, or the like. The styles are innumerable; but may consist of patterns of circles, diamonds, heart shapes, panther paws, and the like. Preferably, designs may include the knees, buttocks area, thighs, below the knee area and stripes along the side of pants construction. Such designs of the pants construction may vary in an infinite number of combinations of design elements, and is appreciated by those skilled in the art of fashion.

In still another embodiment of the present invention, the undergarment material ends at the point where the undergarment 21 is attached to the pants 31, and is non-existent below this line 32. In this embodiment, the undergarment 21 is in the form of a look-alike, wherein the undergarment 21 is not whole, but instead only includes the portion of the undergarment 23 which is visible outside of the pants. The undergarment look-alike may either be removably attached to the pants or sewn to the pants in the same manner as described hereinabove. The advantage of this embodiment is that the user may wear an additional pair of normal, full-size undergarments underneath the pants construction, and such an undergarment will not interfere with the undergarment look-alike. Alternatively, wearers may forgo wearing an additional, full-size undergarment, so that they will have plenty of extra room in the crotch region to provide for extra comfort, especially for those who are accustomed to wearing pants without wearing an undergarment.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A pants construction comprising:

a. a pair of pants having an inside portion, an outside portion and a waistband, said pants being of adequate size to be capable of being worn by a wearer having a waist and a buttocks having a top edge and a bottom edge;

b. an undergarment having an upper portion, a lower portion and a waistband, said undergarment being removably attached to said inside portion of said pair of pants by an attachment means that remains hidden inside said pair of pants, the attachment being such that at least some of said upper portion of said undergarment is revealed above substantially the entire circumference of said waistband of said pants and said waistband is below said waist of said wearer, whereby said waistband of said undergarment is worn substantially near the waist of said wearer;

c. said attachment means being disposed along a perimeter located on said undergarment, and being operable to removably attach said undergarment to said inside portion of said pair of pants along said waistband of said pair of pants, and said undergarment further comprising a first horizontal row of attachment means at said upper portion of said undergarment and a second horizontal row of attachment means at said lower portion of said undergarment, such that said wearer may select sag length by attaching said undergarment to an appropriate row of said attachment means located on said undergarment; and d. a securing mechanism attached to said waistband of said undergarment to provide stabilization to prevent said pants from falling down.

2. The pants construction recited by claim 1, wherein said attachment means covers 5% to 100% of the circumference of said inside portion of said pair of pants, and correspondingly, said undergarment.

3. The pants construction recited by claim 1, wherein said attachment means covers at least 25% of circumference of said inside portion of said pair of pants, and correspondingly, said undergarment.

4. The pants construction recited by claim 1, wherein said attachment means covers at least 50% of circumference of said inside portion of said pair of pants, and correspondingly, said undergarment.

5. The pants construction recited by claim 1, wherein said attachment means cover at least 75% of circumference of said inside portion of said pair of pants and corresponding said undergarment.

6. The pants construction recited by claim 1, wherein said attachment means cover 100% of circumference of said inside portion of said pair of pants, and correspondingly, said undergarment.

7. The pants construction recited by claim 1, wherein said securing mechanism comprises a drawstring.

8. The pants construction recited by claim 1, wherein said securing mechanism comprises an elastic waistband.

9. The pants construction recited by claim 1, wherein said securing mechanism comprises a combination of a drawstring and an elastic waistband.

10. The pants construction recited by claim 1, wherein said undergarment comprises boxer shorts.

11. The pants construction recited by claim 1, wherein said undergarment comprises briefs.

12. The pants construction recited by claim 1, wherein said undergarment comprises panties.

13. The pants construction recited by claim 1, wherein said undergarment comprises a thong.

14. The pants construction recited by claim 1, wherein said undergarment comprises a g-string.

15. The pants construction recited by claim 1, wherein said undergarment comprises lingerie.

16. The pants construction recited by claim 1, wherein said undergarment comprises long johns.

17. The pants construction recited by claim 1, wherein each of said undergarment and said pants has a different overall design.

18. The pants construction recited by claim 1, wherein said undergarment is composed of material having a thickness ranging from less than half as thick to more than twice as thick as conventional undergarment material.

19. The pants construction recited by claim 1, wherein said attachment means is disposed along a perimeter located on said undergarment, and is operable to removably attach said undergarment to said inside portion of said pair of pants, along said waistband of said pair of pants.

20. The pants construction recited by claim 1, wherein said undergarment comprises a third horizontal row of attachment means in-between said upper and lower portions of said undergarment, respectively, such that said wearer may select sag length by attaching said undergarment to an appropriate row of said attachment means located on said undergarment.

21. The pants construction recited by claim 1, wherein said undergarment is removably attached, along a penmeter located on bottom edge of said lower portion of said undergarment, to said inside portion of said pair of pants.

22. The pants construction recited by claim 1, wherein said undergarment is removably attached, along a perimeter located on bottom edge of said lower portion of said undergarment, to said inside portion of said pair of pants, and said pants construction further comprises one or more horizontal rows of attachment means at various locations, such that said wearer may select sag length by attaching said undergarment to an appropriate row of said attachment means located on said pants.

23. The pants construction recited by claim 1, wherein said undergarment is removably attached, along a perimeter located on a bottom edge of said lower portion of said undergarment, to said inside portion of said pair of pants, and said pants further comprises three horizontal rows of attachment means at various locations, such that said wearer may select sag length by attaching said undergarment to an appropriate row of said attachment means located on said pants.

24. The pants construction recited by claim 1, wherein said undergarment is removably attached to said inside portion of said pair of pants by a hook and loop type fastener.

25. The pants construction recited by claim 1, wherein said undergarment is removably attached to said inside portion of said pair of pants by buttons.

26. The pants construction recited by claim 1, wherein said undergarment is removably attached to said inside portion of said pair of pants by zippers.

27. The pants construction recited by claim 1, wherein said undergarment is removably attached to said inside portion of said pair of pants by snaps.

28. The pants construction recited by claim 1, wherein said pants have a perimeter and include small apertures located along a horizontal plane on the perimeter, said undergarment includes tie strings along a lower edge of said lower portion of said undergarment, and said undergarment is removably attached to said pair of pants by inserting said tie strings into said apertures and tying said tie strings.

29. The pants construction recited by claim 1, wherein said undergarment is removably attached to said inside portion of said pair of pants by temporary glue, and said temporary glue is washed out of said pants construction through a post process.

30. The pants construction recited by claim 1, wherein said pants comprise shorts.

31. The pants construction recited by claim 1, wherein said pants comprise athletic shorts.

32. The pants construction recited by claim 1, wherein said pants comprise swim suits.

33. The pants construction recited by claim 1, wherein said pants comprise a skirt.

34. The pants construction recited by claim 1, wherein said pants comprise a mini-skirt.

35. The pants construction recited by claim 1, wherein said pants comprise jeans.

36. The pants construction recited by claim 1, wherein said pants comprise sweatpants.

37. The pants construction recited by claim 1, wherein said pants comprise warm-up pants.

38. The pants construction recited by claim 1, wherein said pants comprise slacks.

39. The pants construction recited by claim 1, wherein said waistband of said pants is located at or substantially near said top edge of said buttocks.

40. The pants construction recited by claim 1, wherein said waistband of said pants is located at or substantially near said bottom edge of said buttocks.

41. The pants construction recited by claim 1, wherein said waistband of said pants is located at a midpoint between said top edge and said bottom edge of said buttocks.

42. The pants construction recited by claim 1, wherein said waistband of said pants is located in-between said top edge and said bottom edge of said buttocks.

43. The pants construction recited by claim 1, wherein said waistband of said pants is located below said bottom edge of said buttocks.

44. The pants construction recited by claim 1, wherein said waistband of said pants further comprises belt loops.

45. The pants construction recited by claim 1, wherein said waistband of said pants further comprises an outer drawstring.

46. The pants construction recited by claim 1, wherein said waistband of said pants further comprises an outer drawstring, said drawstring being purposefully left loose to convey a perception that said pants are about to fall down.

47. The pants construction recited by claim 1, wherein said waistband of said pants further comprises a button-fly.

48. The pants construction recited by claim 1, wherein said waistband of said pants further comprises a button-fly, and said button-fly is purposefully left loose to convey a perception that said pants are about to fall down.

49. The pants construction recited by claim 1, wherein said waistband of said pants further comprises a zipper-fly.

50. The pants construction recited by claim 1, wherein said waistband of said pants further comprises a zipper-fly, and said zipper-fly is purposefully left loose to convey a perception that said pants are about to fall down.

51. The pants construction recited by claim 1, wherein removable pockets are removably attached to said pants.

52. The pants construction recited by claim 1, wherein said wearer is an infant.

53. The pants construction recited by claim 1, wherein said wearer is an adult.

54. The pants construction recited by claim 1, wherein said wearer is a male.

55. The pants construction recited by claim 1, wherein said wearer is a female.

56. The pants construction recited by claim 1, wherein said wearer has a height ranging from 10 inches to 100 inches.

57. The pants construction recited by claim 1, wherein said attachment means is disposed along a perimeter located on said undergarment, and is operable to removably attach said undergarment to said inside portion of said pair of pants, along a perimeter that is substantially near said waistband of said pair of pants.

58. The pants construction recited by claim 1, wherein said attachment means is disposed along a perimeter located on said undergarment, and is operable to removably attach said undergarment to said inside portion of said pair of pants, along a perimeter at the uppermost portion of said pair of pants and just below said waistband of said pair of pants.

59. A pants construction comprising;

a. a pair of pants having an inside portion, an outside portion and a waistband, and having adequate size to be capable of being worn by a wearer, said pants having a waist and a buttocks provided with a top edge and a bottom edge;

b. an undergarment look-alike, said undergarment look-alike having an upper portion, a lower portion and a waistband, and being removably attached to said inside portion of said pair of pants by an attachment means that remains hidden inside said pair of pants, causing at least some of said upper portion of said undergarment look-alike to be revealed above substantially the entire circumference of said waistband of said pants, the attachment being such that said waistband of said pants is below said waist of said wearer, and said waistband of said undergarment look-alike is worn substantially near said waist of said wearer;

c. said attachment means being disposed along a perimeter located on said undergarment look-alike, and being operable to removably attach said undergarment look-alike to said inside portion of said pair of pants along said waistband of said pair of pants, and said undergarment look-alike further comprising a first horizontal row of attachment means at said upper portion of said undergarment look-alike and a second horizontal row of attachment means at said lower portion of said undergarment look-alike, such that said wearer may select sag length by attaching said undergarment look-alike to an appropriate row of said attachment means located on said undergarment look alike; and d. a securing mechanism attached to said waistband of said undergarment look-alike to provide stabilization to prevent said pants from falling down.

* * * * *